US010156063B2

(12) United States Patent
Barish

(10) Patent No.: US 10,156,063 B2
(45) Date of Patent: Dec. 18, 2018

(54) CHILD-PROOF TOILET HANDLE LOCK

(71) Applicant: Christopher Barish, Nyack, NY (US)

(72) Inventor: Christopher Barish, Nyack, NY (US)

( * ) Notice: Subject to any disclaimer, the term of this patent is extended or adjusted under 35 U.S.C. 154(b) by 8 days.

(21) Appl. No.: 15/405,882

(22) Filed: Jan. 13, 2017

(65) Prior Publication Data

US 2017/0321405 A1 Nov. 9, 2017

Related U.S. Application Data

(60) Provisional application No. 62/332,848, filed on May 6, 2016.

(51) Int. Cl.
*E03D 5/08* (2006.01)
*E03D 5/09* (2006.01)
*E03D 5/02* (2006.01)

(52) U.S. Cl.
CPC ..... *E03D 5/09* (2013.01); *E03D 5/026* (2013.01); *A47K 2201/00* (2013.01)

(58) Field of Classification Search
CPC ..... E03D 5/092
USPC ..... 4/300–442
See application file for complete search history.

(56) References Cited

U.S. PATENT DOCUMENTS 3,358,294 A * 12/1967 Nolan ..... E03D 5/026 251/89
3,719,957 A * 3/1973 Riedel ..... E03D 1/34 4/324
4,145,774 A * 3/1979 Sullivan ..... E03D 1/144 4/249
4,319,368 A * 3/1982 Peters ..... E03D 5/026 4/253
4,356,576 A * 11/1982 Gala ..... E03D 5/09 4/324
5,771,502 A * 6/1998 O'Grady ..... E03D 5/026 4/249
7,434,275 B1 * 10/2008 DeVore ..... E03D 5/02 4/378
2003/0150053 A1 * 8/2003 Rische ..... E03D 1/308 4/405
2004/0154087 A1 * 8/2004 Hogues, Jr. ..... E03D 5/08 4/405
2008/0010734 A1 * 1/2008 Chang ..... E03D 3/10 4/405

(Continued)

FOREIGN PATENT DOCUMENTS

WO WO 1982001987 6/1982

*Primary Examiner* — Lori Baker
(74) *Attorney, Agent, or Firm* — Leason Ellis LLP

(57) ABSTRACT

A toilet handle lock device for selectively preventing a handle of a toilet from moving in a flushing motion is formed of a housing having a rear surface for attachment to a tank of the toilet. The device further includes a biased lock member at least partially disposed within the housing and moving in a linear direction between an extended locked position in which the biased lock member is positioned for blocking the handle of toilet and preventing the handle from undergoing a downward flushing motion and a retracted unlocked position in which the biased lock member is spaced from the handle of the toilet. An actuator is provided for releasing the biased lock member from the extended locked position and permitting the biased lock member to move to the retracted unlocked position.

15 Claims, 10 Drawing Sheets

(56) References Cited

U.S. PATENT DOCUMENTS

2008/0072371 A1* 3/2008 Rogers ..... E03D 5/09
4/405

* cited by examiner

CHILD-PROOF TOILET HANDLE LOCK

CROSS-REFERENCE TO RELATED APPLICATION

The present application claims priority to U.S. patent application Ser. No. 62/332,848, filed May 6, 2016, which is hereby incorporated by reference in its entirety.

TECHNICAL FIELD

The present application relates to a flush toilet and more specifically, relates to the handle of a flush toilet, and is used as a blocking apparatus on the outside facing of the toilet to prevent the handle from being flushed. One objective of the present invention is to keep infants and potty-training toddlers from flushing foreign objects down the toilet drain and as a reminder for individuals to flush less often to conserve water.

BACKGROUND

Infants and toddlers are curious by nature. A frequent target of their fascination is the household toilet bowl and the flush handle in particular. This is especially true during the potty training phase when children are within finger's reach of the toilet's handle.

Quite often children, before a guardian can see them, will place foreign items into the toilet bowl (toys, phones, washcloths, food, etc.) and then flush the handle simply to see how it works or because they find it enjoyable. Unfortunately, such action often causes blocked pipes, sewage line, septic tank, or toilet bowl damage, water overflow, and loss of valuables. Moreover, it is an unnecessary waste of Earth's most precious resource.

The financial expense can be a crushing blow for today's working families who are struggling to make ends meet. Not to mention the aggravation, time wasted, and inconvenience that a flushing "disaster" can create.

To prevent a child from flushing unwanted objects down the drain, there exist toilet lid locks, which attempt to render the water inside the toilet bowl inaccessible to them. But this type of product does in no way prevent a child from accessing the toilet handle. Most importantly, and for obvious reasons, a toilet lid lock cannot aide in the critical process of potty training, when a child must be seated atop an open toilet to "do his business".

SUMMARY

The present apparatus positively prevents infants and toddlers from being able to fully flush down a toilet handle. The apparatus adheres directly beneath a toilet handle to block its movement, thus locking the lever in place, and preventing it from being flushed by very young children. A simple push button on the apparatus deactivates the lock and allows adults or older children to easily flush the toilet. The unit then automatically resets into childproof mode.

In one embodiment, the invention is directed to toilet handle lock device for selectively preventing a handle of a toilet from moving in a flushing motion is formed of a housing having a rear surface for attachment to a tank of the toilet. The device further includes a biased lock member at least partially disposed within the housing and moving in a linear direction between an extended locked position in which the biased lock member is positioned for blocking the handle of toilet and preventing the handle from undergoing a downward flushing motion and a retracted unlocked position in which the biased lock member is spaced from the handle of the toilet. An actuator is provided for releasing the biased lock member from the extended locked position and permitting the biased lock member to move to the retracted unlocked position.

Additional elements and advantages of the invention will be detailed in the illustrations, descriptions.

BRIEF DESCRIPTION OF THE DRAWING FIGURES

DETAILED DESCRIPTION OF CERTAIN EMBODIMENTS

FIGS. 1-16 illustrate a toilet handle lock device 100 according to one exemplary embodiment of the present invention. The toilet handle lock device 100 is an assembly formed of a number of parts that are each described hereinbelow.

Figure 1:
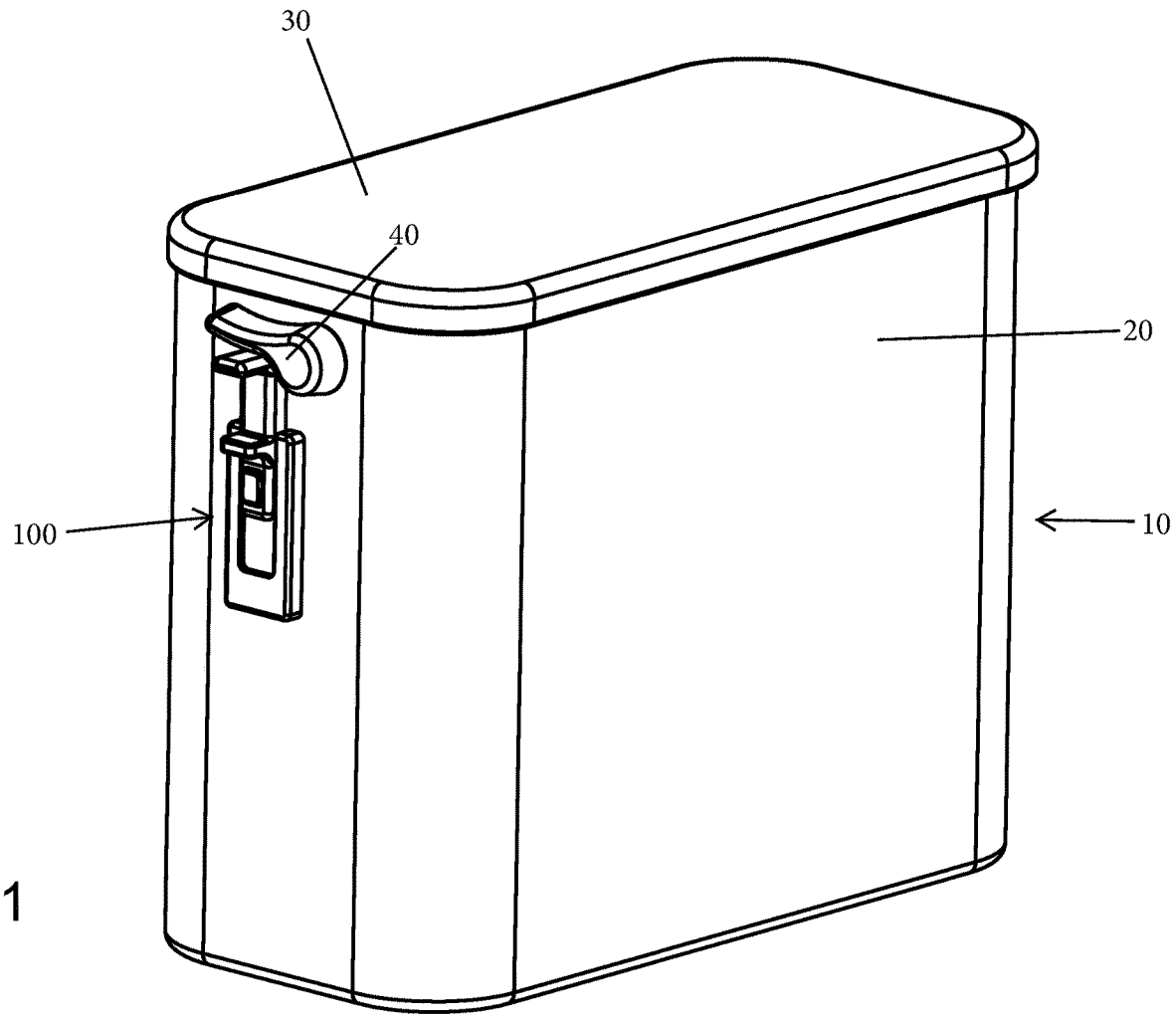
FIG. 1 is an angled, side view of toilet; with a toilet handle lock device in accordance with the present invention in a locked position, mounted beneath the toilet handle.
Figure 2:
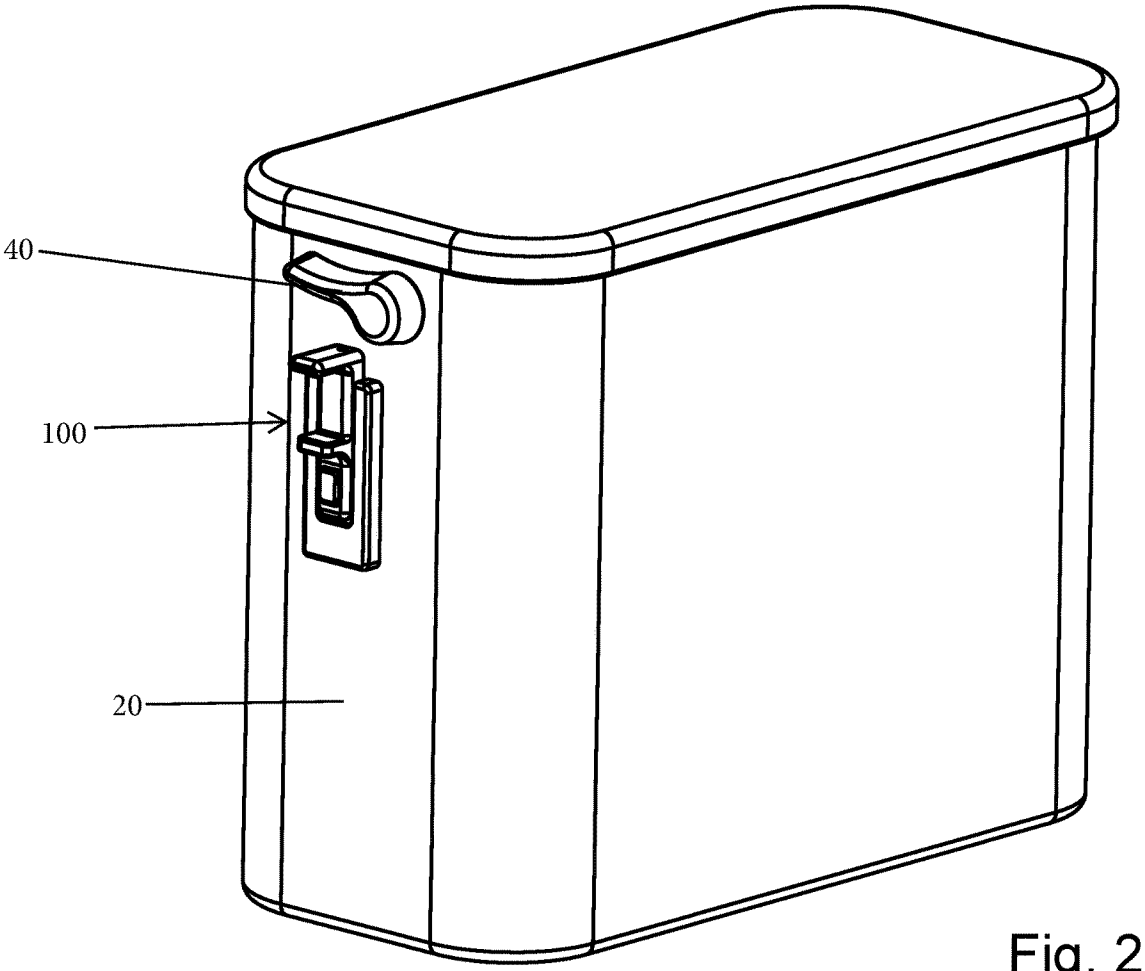
FIG. 2 is the same view, now showing the toilet handle lock device in the unlocked position.
Figure 3:
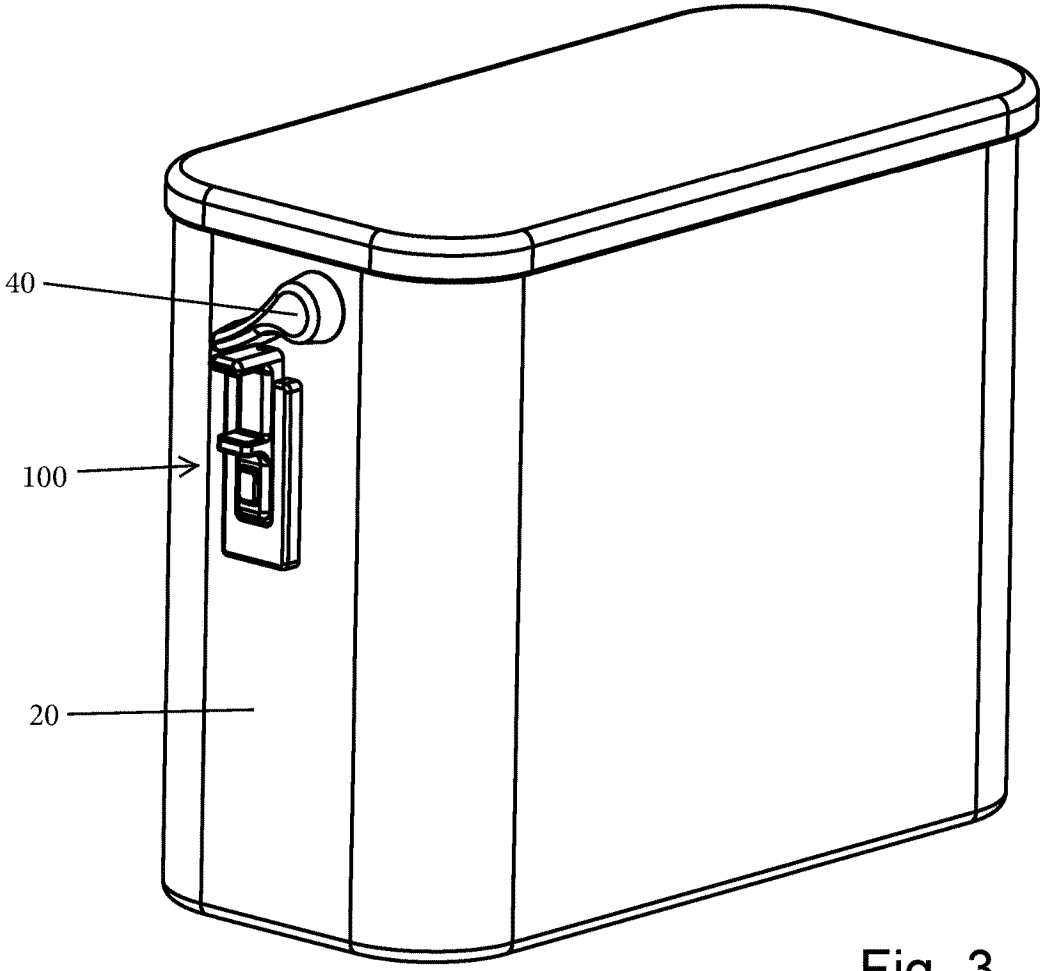
FIG. 3 is the same view, now showing the toilet handle being flushed with the toilet handle lock device still in the unlocked position.
Figure 4:
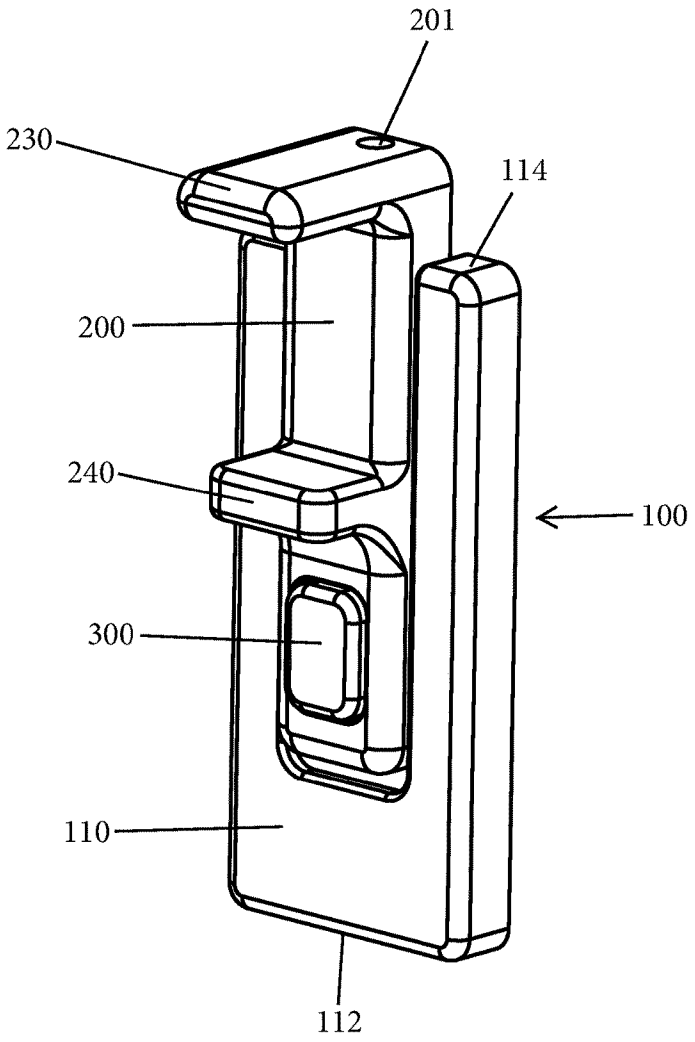
FIG. 4 is a close-up angled view of the toilet handle lock device in the unlocked position.
Figure 5:
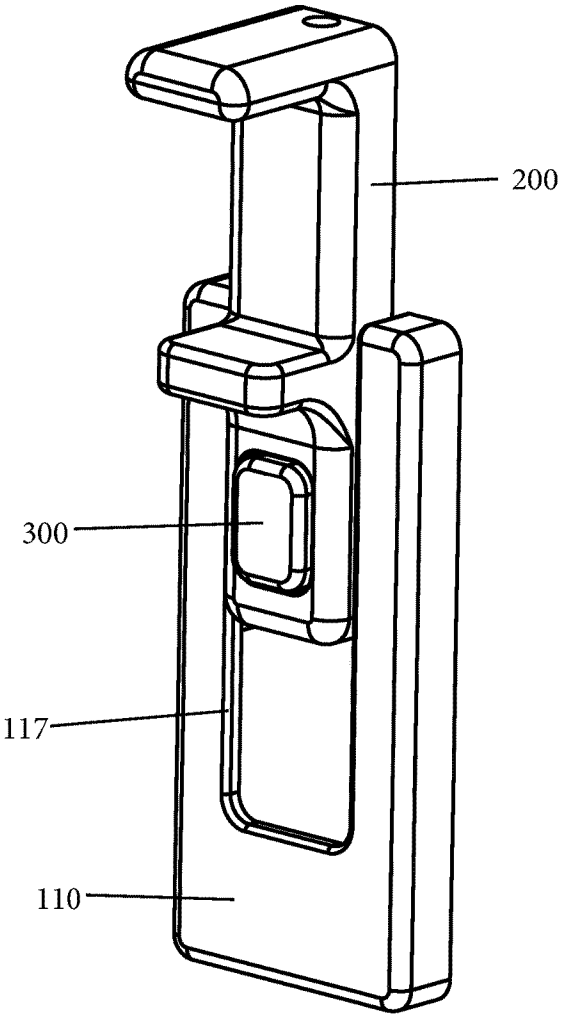
FIG. 5 is a close-up, angled view of the toilet handle lock device in the locked position.
Figure 7:
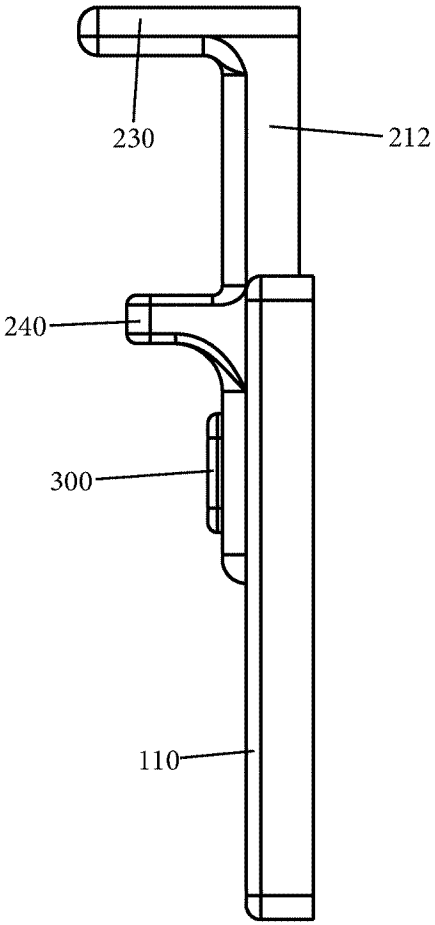
FIG. 7 is a side view of the toilet handle lock device in the locked position.
Figure 6:
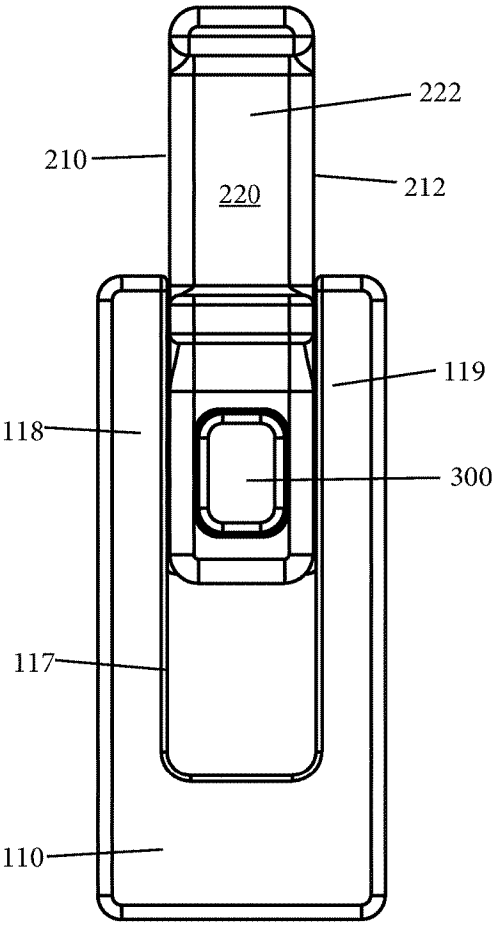
FIG. 6 is a front view of the toilet handle lock device in the locked position.

FIGS. 1-3 illustrate the toilet handle lock device 100 in its intended application in which the toilet handle lock device 100 is associated with a toilet 10. The toilet 10 can be of a conventional design and includes a tank 20 and a cover or lid 30. The toilet 10 includes an internal mechanical linkage (not shown) that operates the toilet 10 and includes an external toilet handle 40 that is operatively connected to the internal mechanical linkage.

FIG. 1 shows the toilet handle lock device 100 in a locked position and mounted beneath the toilet handle 40. As described herein, the toilet handle lock device 100 is configured such that in the locked position, the toilet handle lock device 100 prevents the external toilet handle 40 from operating and moving in a downward flushing motion. FIG. 2 shows the toilet handle lock device 100 in an unlocked position which allows the external toilet handle 40 to operate since a locking portion, described below, of the toilet handle lock device 100 is now spaced from the external toilet handle 40 to allow movement (pivoting) thereof. FIG. 3 show the external toilet handle 40 having undergone a downward flushing motion and the toilet handle lock device 100 remains in the unlocked position.

Referring to FIGS. 4-16, the toilet handle lock device 100 includes a housing that is formed of a front housing 110 and a rear housing 130. The housing contains many of the working components of the toilet handle lock device 100 and more specifically, the housing at least partially contains a biased lock member (e.g., a lock lever) 200 and an actuator 300. The toilet handle lock device 100 is secured to the toilet tank 20 with a fastener 500 or the like that results in the toilet handle lock device 100 being securely coupled to the toilet tank 20 at a preselected position which is selected such that it in locked position, the toilet handle lock device 100 prevents the external toilet handle 40 from moving in the downward flushing motion.

The front housing 110 has a first closed end 112 and an opposite second end 114 which is partially open in that an opening or notch 115 is formed in an end wall at the second end 114. A front face (surface) 116 of the front housing 110 includes a slot 117 that extends from a location spaced from the first closed end 112 to the second end 114. The slot 117 opens into and is in communication with the opening 115 formed along the second end 114. As shown the slot 117 can generally have a U-shape. The formation of the slot 117 thus defines first and second arms 118, 119 that terminate at the second end 114.

The rear housing 130 is constructed to mate with the front housing 110 to form the assembled housing. The rear housing 130 has a front face 131 and an opposing rear face 132. The rear face 132 is preferably a smooth face, while the front face 131 has a number of upstanding structures. More specifically, a first end 133 of the rear housing 130 has a first upstanding rail or tab 140 and first and second longitudinal rails or tabs 142, 144 are formed along the side opposing side edges of the rear housing 130. The first and second longitudinal rails 142, 144 are thus parallel to one another and are oriented perpendicular to the first upstanding rail 140. Along an inner surface of each of the first and second longitudinal rails 142, 144 is a stop (protrusion) 150. The two stops 150 are located directly opposite one another.

At or proximate the second end 135, the rear housing 130 includes a hollow boss like structure 160. The boss 160 protrudes outwardly from the first face 131 and has a bore 162 formed therein. An inner end of the boss 160 is closed ended, while an outer end of the boss 160 is open and defines the entrance into the bore 162. The boss 160 has a generally cylindrical shape and the bore 162 is circular in shape; however, it will be understood that other shapes can be used for both structures. The boss 160 can also be thought of as being a spring retainer as described herein.

Figure 8:
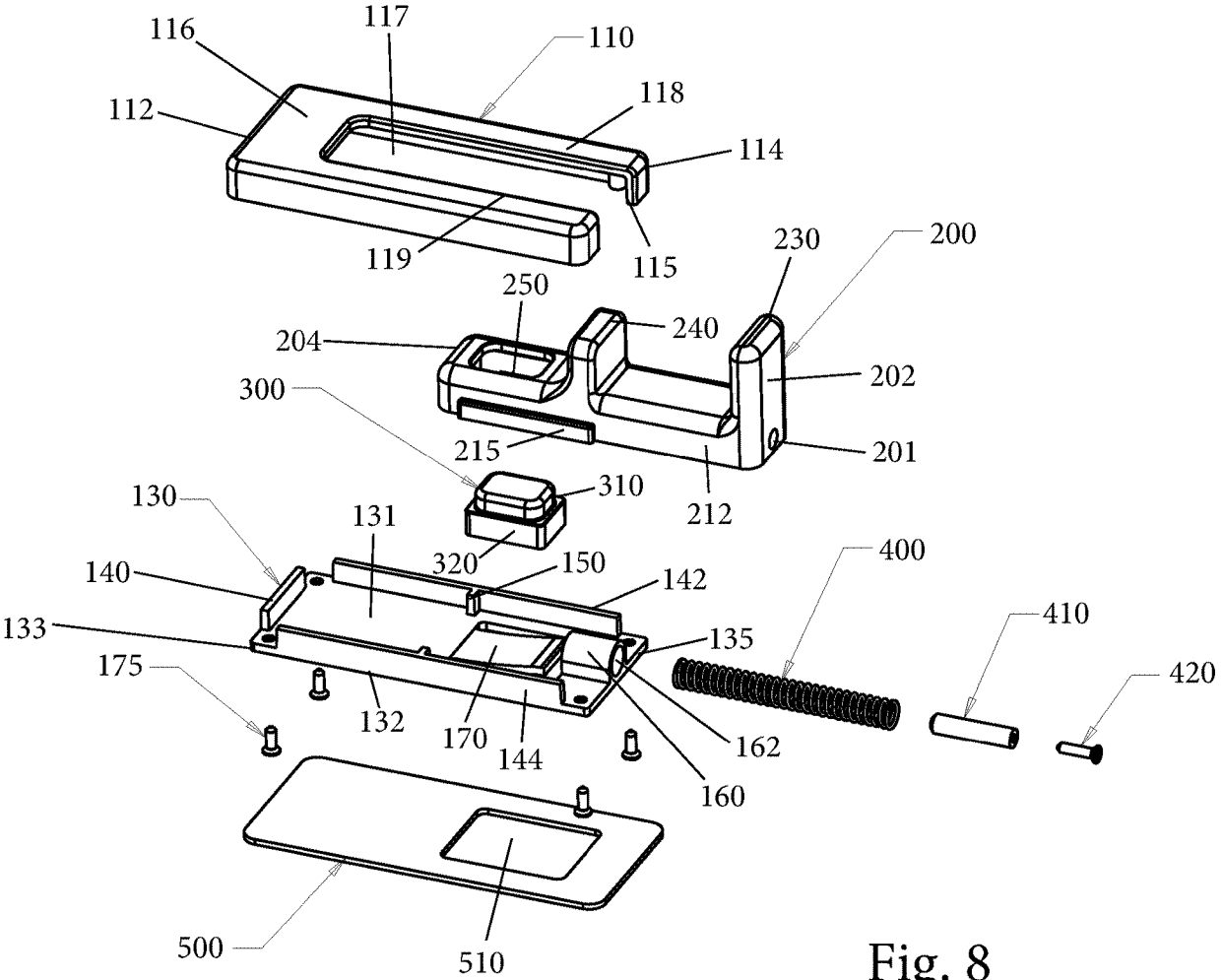
FIG. 8 is an exploded perspective view of the toilet handle lock device.
Figure 13:
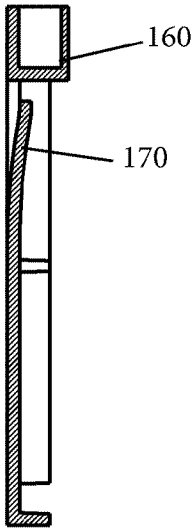
FIG. 13 is a cross-sectional view taken along the line 13-13 of FIG. 12.
Figure 12:
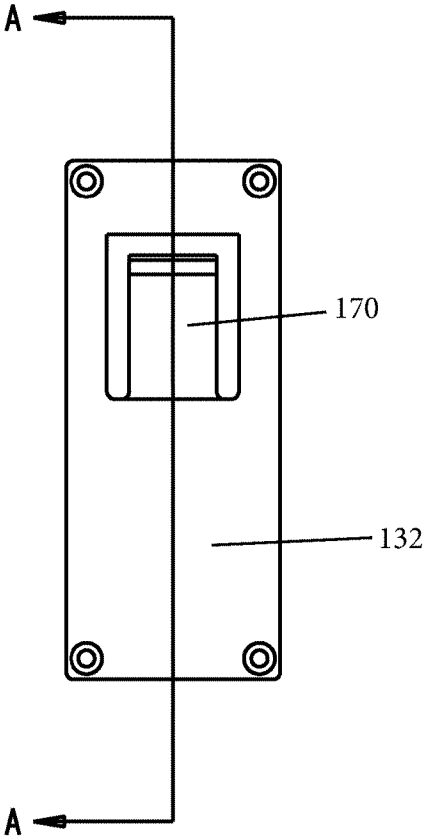
FIG. 12 is a rear elevation view of the rear housing.
Figure 10:
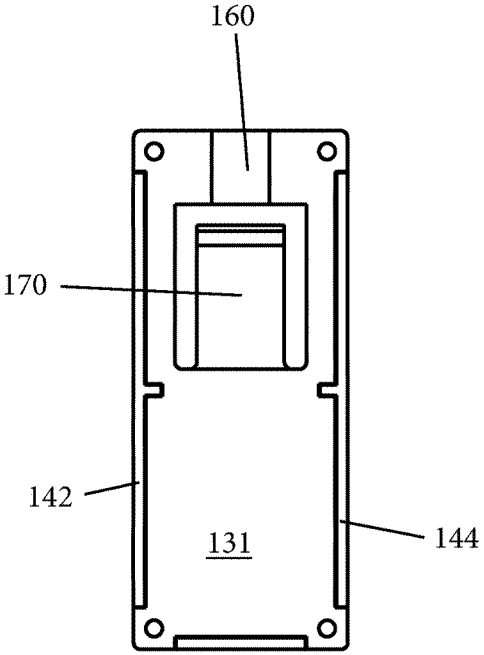
FIG. 10 is a front view of a rear housing of the toilet handle lock device.
Figure 11:
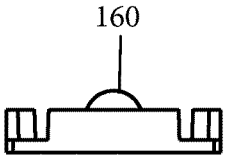
FIG. 11 is an end view of the rear housing.
Figure 16:
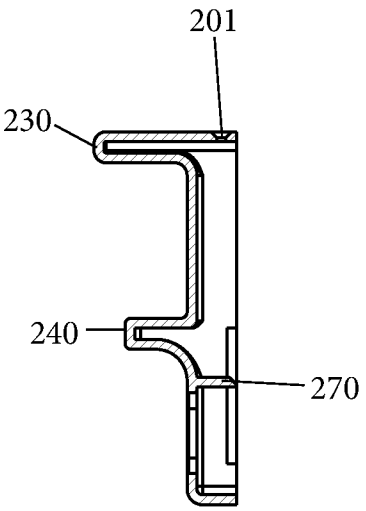
FIG. 16 is a cross-sectional view taken along the line 16-16 of FIG. 15.
Figure 15:
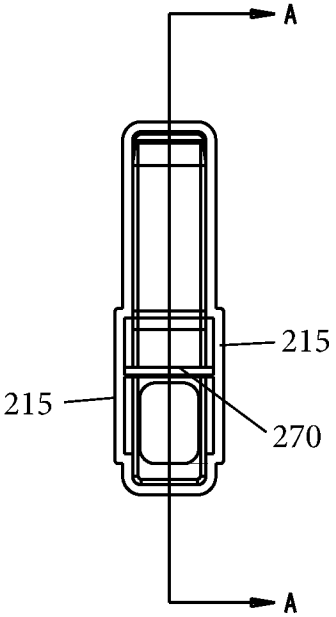
FIG. 15 is a rear view of the lock lever.
Figure 14:
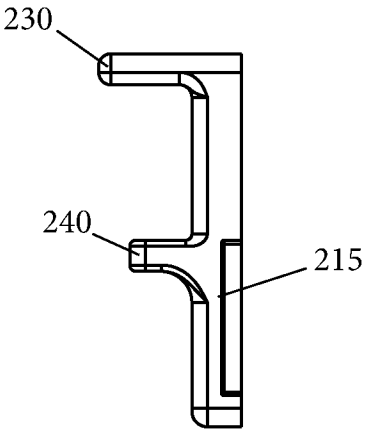
FIG. 14 is a side view of a lock lever of the toilet handle lock device.

The rear housing 130 also includes a latch 170 that is configured to act as a locking member as described herein. In addition, the latch 170 is configured to function as a spring tab and moves between a first (locked) position and a second (unlocked) position. As illustrated, the rear housing 130 has an opening formed therein and said opening defines the latch 170. The latch 170 is a flexible cantilevered structure in that it has a free end 172 and it flexes between the first and second positions. As shown in FIGS. 8 and 13, in a normal rest position, the latch 170 and in particular the distal end portion thereof that terminates in the free end 172 protrudes outwardly away from the front face 131 and thus has an out of the plane configuration.

Since the latch 170 is a spring tab, the latch 170 can flex when a force (load) is applied thereto. The first (locked) position is the position in which the latch 170 is in the out of plane configuration, while the second (unlocked) position is the position in which the latch 170 is at least substantially in an in plane configuration relative to the surrounding wall of the rear housing 130.

As shown in FIG. 8, the front housing 110 and the rear housing 130 are coupled to one another using conventional means, such as the use of fasteners 175. In the illustrated embodiment, the four corners of the rectangular shaped front and rear housings 110, 130 include fasteners 175.

The biased lock member (e.g., the lock lever) 200 of the toilet handle lock device 100 is the structure that prevents the external toilet handle 40 from operating when the device is in the locked position. Thus, the biased lock member 200 moves between an at least substantially fully extended locked position and a retracted unlocked position. As shown in the figures, the biased lock member 200 has a first end 202 and an opposite second end 204. As shown, the biased lock member 200 is at least partially disposed between the front housing 110 and the rear housing 130. The biased lock member 200 is an at least partially hollow structure.

The biased lock member 200 has first and second side walls 210, 212 that are parallel to one another and also includes a front wall 220 that defines a front face 222. Along each of the side walls 210, 212, a longitudinal rail 215 is formed. The rail 215 thus protrudes outwardly from the side wall 210, 212. As will be described in more detail, the rail 215 is located generally in the bottom half of the biased lock member 200.

The biased lock member 200 includes a pair of protrusions, namely, a first protrusion (first shelf) 230 and a second protrusion (second shelf) 240 that is spaced therefrom. The first and second protrusions 230, 240 are in the form of tabs or fingers that protrude outwardly from the front wall 220. The first protrusion 230 is formed at the first end 202, while the second protrusion 240 is formed intermediate to the first and second ends 202, 204. The dimensions of the first and second protrusions 230, 240 can be different from one another (as illustrated) or can the same. In the illustrated embodiment, the first protrusion 230 is longer and thus protrudes further away from the front wall 220. While two protrusions 230, 240 are shown, it will be appreciated that the biased lock member 200 can include only one protrusion, such as the first protrusion 230.

The first and second protrusions 230, 240 serve different purposes and in particular, the first protrusion 230 serves as the locking member that prevents the toilet handle 40 from moving in a downward flushing motion. The second protrusion 240 serves as a reset member in that, under select conditions described below, the user can apply a downward force to the second protrusion 240 to cause the second protrusion to move from the extended, locked position to the retracted, unlocked position. Under select operating conditions, the user simply applies a downward force to the second protrusion 240 using either a finger or thumb to cause the biased lock member 200 to move from the fully extended, locked position to the retracted, unlocked position.

The biased lock member 200 also includes an opening 250 that is formed between the second end 204 and the second protrusion 240. The opening 250 is sized and shaped to receive the actuator 300. In the illustrated embodiment, the opening 250 is generally square or rectangular (oblong)

shaped with rounded corners; however, it will be appreciated that the opening 250 can have other shapes, including but not limited to circular or oval.

As shown, within the hollow cavity of the biased lock member 200 there is an inner wall 270 that extends transversely across the biased lock member 200 (i.e., between the side walls 210, 212). The inner wall 270 does not extend below the bottom edges of the side walls 210, 212 and the two opposing end walls of the biased lock member 200.

The biased lock member 200 is configured to be received and ride within the slot 117 formed in the front housing 120.

As the first end 202, the biased lock member 200 also has an opening 201 that provides an entrance into the hollow cavity of the biased lock member 200.

The actuator 300 is designed to selectively operate the biased lock member 200 and allow the user to easily position the biased lock member 200 into either the fully extended, locked position or the retracted, unlocked position. In the illustrated, the actuator 300 is in the form of a lock button that can be actuated to allow controlled movement of the biased lock member 200. The actuator 300 can thus be in the form of a lock button that moves between a first position and a second position. As shown in the figures, the actuator 300 can be in the form of a button defined by a hollow body that has a stepped construction in that the lock button 300 has a first stepped (outer) portion 310 and a second stepped (inner) portion 320, with a shoulder 325 being defined therebetween. The first stepped portion 310 has smaller dimensions than the second stepped portion 320. The first stepped portion 310 is configured to be received within the opening 250 formed in the biased lock member 200; however, the second stepped portion 320 has dimensions greater than the opening 250 and therefore, the lock button 300 cannot pass through the opening 250 but instead, the lock button 300 is captured within the biased lock member 200. The lock button 300 thus is carried by the biased lock member 200 and therefore, as the biased lock member 200 moves in a sliding manner, the lock button 300 is carried therewith.

Figure 9:
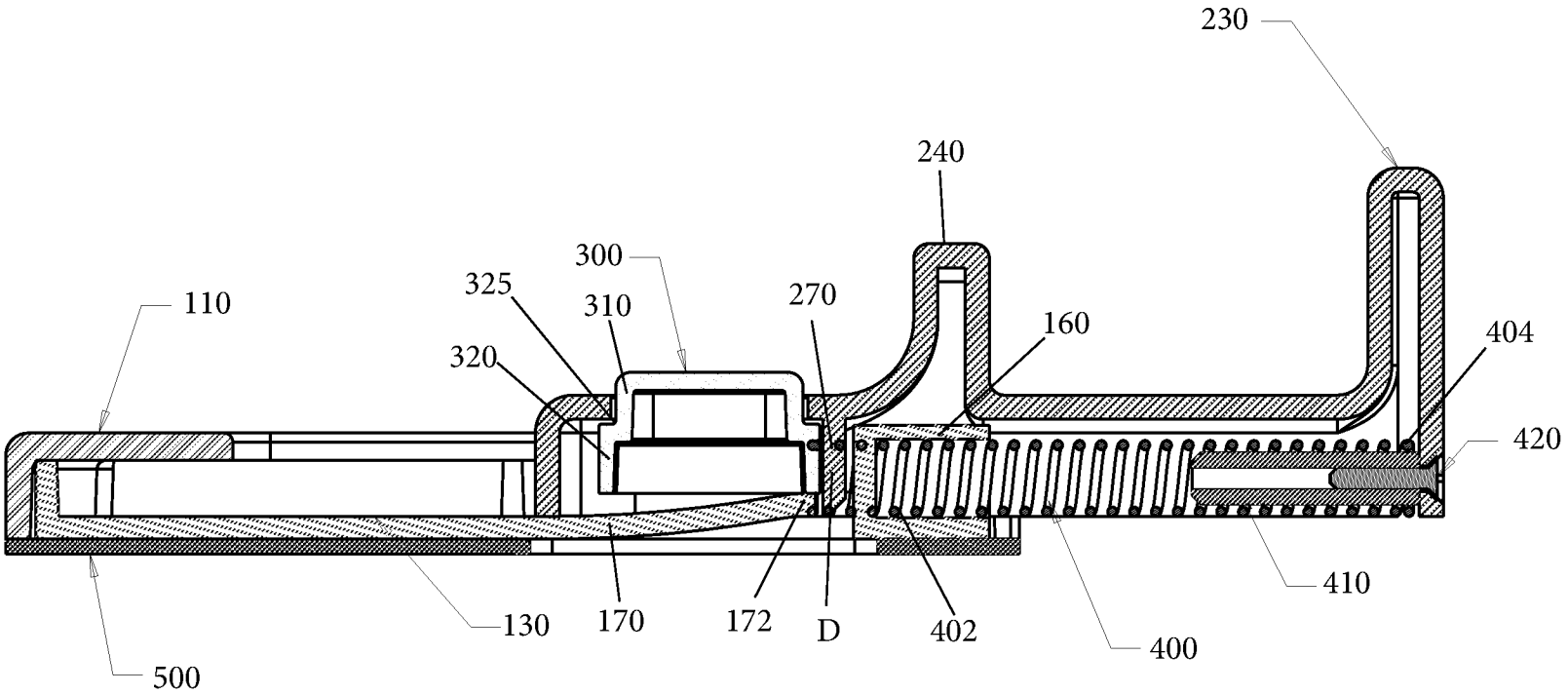
FIG. 9 is a cross-sectional view taken through the toilet handle lock device.

As shown in FIG. 9, in the fully extended locked position of the biased lock member 200, the lock button 300 is positioned relative to the latch 170 such that the latch 170 applies a return force to the lock button 300 (i.e., the second stepped portion 320 thereof) to cause the lock button 300 to be biased in an outward direction away from the rear housing 130. As can be seen in FIG. 9, the flexed free end 172 of the latch 170 is in contact with the bottom edge of the second stepped portion 320.

The device 100 also includes a biasing means or biasing element 400 which can be in the form of an elongated metal spring 400 (e.g., coil spring) that has a first end 402 and an opposing second end 404. The first end 402 is received within the bore (opening) 162 of the boss 160 and the second end 404 is received within the hollow interior of the biased lock member 200 so as to apply a force to the first end 202 thereof. The spring 400 can be securely coupled to the biased lock member 200 using a lock spring guide 410 and a fastener 420. The lock spring guide 410 is a tubular structure that is shaped and sized to be received within a central longitudinal opening of the spring 400. The fastener 420 passes through the opening 201 at the first end 202 and engages and is securely attached to the lock spring guide 410, thereby attaching the spring 400 to the biased lock member 200. For example, the lock spring guide 410 can have inner threads that threadingly mate with threads of the fastener 420 (e.g., a screw).

Since the boss 160 is a fixed part that does not move and the first end 402 of the spring 400 is captured therein, the closed end of the boss 160 acts as a stop for the spring 400 and restricts the movement of the spring 400. As shown in FIG. 9, in the fully extended, unlock position of the biased lock member 200, the spring 400 is in relaxed, rest position in which stored energy has been released. In contrast, when the biased lock member 200 assumes the retracted, unlocked position, the spring 400 is compressed and stores energy.

The complete operation of the toilet handle lock device 100 is now described. When in the locked position, the lock button 300 prevents the biased lock member 200 from sliding due to the interference between the free end 172 of the latch 170 and the inner wall 270 of the biased lock member 200. The interference prevents the biased lock member 200 from being retracted from the fully extended, lock position without operation of the lock button 300. As mentioned above, the force of the spring 400 against the biased lock member 200 ensures that the biased lock member 200 is maintained in this position.

When the lock button 300 is pushed, it compresses the latch 170 (e.g., plastic spring tab) on the rear housing 130.

This flexing of the latch 170 by the force of the lock button 300 causes the latch 170 to move from the out of plane position to a more in the plane position, thereby removing the interference between latch 170 and the biased lock member 200. The biased lock member 200 is now free to move to the retracted, unlocked position. However, it will be noted that as the biased lock member 200 moves to a fully retracted or even partially retracted position, the spring 400 is compressed and stores energy.

As the user moves the biased lock member 200 to the unlocked position, the first protrusion 230 moves away from the toilet handle 40, thereby allowing the toilet handle 40 to move in the downward flushing motion.

Once the user releases the biased lock member 200 (e.g., by releasing the second protrusion 240), the stored energy in spring 400 is released and the biased lock member 200 is returned to the fully extended position. This mechanism thus ensures automatic resetting of the biased lock member 200.

It will be understood that the biased lock member 200 moves in a linear manner (direction) between the fully extended locked position and the fully retracted unlocked position.

It will be appreciated that the device 100 can be modified so as to include an internal mechanism that holds the biased lock member 200 in the unlocked position. For example, another latch or similar structure can be used to securely maintain the biased lock member 200 in the unlocked position. In this embodiment, the biased lock member 200 can thus be maintained in the unlocked position even when the user releases the lock button 300. To release the biased lock member 200 from this unlocked position, the lock button 300 is pressed and the biased lock member 200 is driven to the locked position as a result of the stored energy of the compressed spring 400 being released.

As mentioned, the toilet handle lock device 100 is intended for secure attachment to the tank 20 of the toilet 10. In one embodiment, the toilet handle lock device 100 includes a fastening element 500 for securely attaching the toilet handle lock device 100 to the tank 20. In one embodiment, the fastening element 500 is in the form of an adhesive element and more specifically, the fastening element 500 is in the form of a double side adhesive tape. A release layer is removed from one face (side) of the fastening element 500 and then this one face is securely adhered to the smooth rear face 132. The release layer is removed from the other face (side) of the fastening element 500 and then this other face is securely adhered to the tank 20, thereby securely attaching the device 100 to the toilet 10.

As shown, the fastening element 500 can include an opening 510 which is sized and positioned so that it is aligned with the spring tab of the rear housing 130. The opening 510 is thus configured to accommodate the flexing movement of the spring tab.

The main components of the device 100, with the exception of the spring 400, can be formed of any number of different materials, including but not limited to suitable plastics.

The first protrusion 230 is designed to prevent custom toilet handles from being flushed, as they are often installed to extend outward from the toilet.

Without the metal spring 400, the lock member 200 would still have the functionality to slide up and down and lock or unlock the toilet handle 40, but the spring 400 provides an automatic reset so that person who last flushed the toilet has peace of mind in knowing that the toilet handle 40 is once again locked, and unflushable by a child.

Without the spring tab push button 300 feature, the biased lock member 200 would still be able to slide up and down to lock or unlock the toilet handle, but it would fail to be child-proof.

It is to be understood that like numerals in the drawings represent like elements through the several figures, and that not all components and/or steps described and illustrated with reference to the figures are required for all embodiments or arrangements.

Thus, illustrative embodiments and arrangements of the present devices and methods provide a method for selectively preventing movement of the toilet handle.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present disclosure, which is set forth in the following claims.

What it claimed is:

1. A toilet handle lock device for selectively preventing a handle of a toilet from moving in a flushing motion comprising:

a housing having a rear surface for attachment to a tank of the toilet;

a biased lock member at least partially disposed within the housing and moving in a linear direction between an extended locked position in which the biased lock member is positioned for blocking the handle of toilet and preventing the handle from undergoing a downward flushing motion and a retracted unlocked position in which the biased lock member is spaced from the handle of the toilet; and an actuator for releasing the biased lock member from the extended locked position and permitting the biased lock member to move to the retracted unlocked position;

wherein the housing includes a front housing portion and a rear housing portion that are securely coupled to one another, with the biased lock member being at least partially disposed between the front and rear housing portions;

wherein the rear housing portion includes a flexible spring tab formed in a rear wall thereof, the flexible spring tab assuming a bent configuration in a rest position thereof, the biased lock member including an inner wall, wherein in the extended locked position, the flexible spring tab seats against the inner wall to create an interference fit that prevents the biased lock member from moving from the extended locked position to the retracted unlocked position.

2. The toilet handle lock device of claim 1, wherein the front housing portion has a slot formed therein, one end of the front housing portion having an opening that opens into the slot, the biased lock member slidingly traveling within the slot between the extended locked position and the retracted unlocked position.

3. The toilet handle lock device of claim 1, wherein in the rest position, the flexible spring tab is in contact with the actuator.

4. The toilet handle lock device of claim 3, wherein the actuator includes a lock button that is positioned adjacent to and in at least partial contact with the flexible spring tab in the extended locked position, the lock button passing through an opening formed in the front housing portion, the lock button being configured such that when an inward force is applied to the lock button, the lock button deforms the bent spring tab such that it assumes a position in which the biased lock member can move linear to the retracted unlocked position.

5. The toilet handle lock device of claim 1, further including a fastening element coupled to the housing for attaching the device to a tank of the toilet.

6. The toilet handle lock device of claim 5, wherein the fastening element comprises double sided adhesive tape.

7. A toilet handle lock device for selectively preventing a handle of a toilet from moving in a flushing motion comprising:

a housing having a rear surface for attachment to a tank of the toilet;

a biased lock member at least partially disposed within the housing and moving in a linear direction between an extended locked position in which the biased lock member is positioned for blocking the handle of toilet and preventing the handle from undergoing a downward flushing motion and a retracted unlocked position in which the biased lock member is spaced from the handle of the toilet;

an actuator for releasing the biased lock member from the extended locked position and permitting the biased lock member to move to the retracted unlocked position; and a spring that is positioned between the rear housing portion and the biased lock member and is configured to apply a biasing force against the biased lock member;

wherein the housing includes a front housing portion and a rear housing portion that are securely coupled to one another, with the biased lock member being at least partially disposed between the front and rear housing portions.

8. The toilet handle lock device of claim 7, wherein one end of the spring seats against a spring retainer formed as part of the rear housing portion and the other end of the spring is coupled to one end of the biased lock member.

9. The toilet handle lock device of claim 8, further including a spring guide in the form of a tubular structure received within a central opening of the spring which is in the form of a coil spring and a fastener passes through an opening in the one end of the biased locked member and is securely attached to the spring guide, thereby securely attaching the other end of the spring to the one end of the biased lock member.

10. The toilet handle lock device of claim 8, wherein the spring retainer comprises a cylindrical boss formed along a rear wall of the rear housing portion.

11. The toilet handle lock device of claim 8, wherein the spring retainer serves as a stop and limits linear movement of the biased lock member by contacting an inner wall formed as part of the biased lock member.

12. A toilet handle lock device for selectively preventing a handle of a toilet from moving in a flushing motion comprising:

a housing having a rear surface for attachment to a tank of the toilet;

a biased lock member at least partially disposed within the housing and moving in a linear direction between an extended locked position in which the biased lock member is positioned for blocking the handle of toilet and preventing the handle from undergoing a downward flushing motion and a retracted unlocked position in which the biased lock member is spaced from the handle of the toilet; and an actuator for releasing the biased lock member from the extended locked position and permitting the biased lock member to move to the retracted unlocked position;

wherein the biased lock member includes a first protrusion at one end thereof that is configured to contact or be spaced proximate the handle of the toilet to prevent the handle of the toilet from undergoing a downward flushing motion.

13. The toilet handle lock device of claim 12, wherein the housing includes a front housing portion and a rear housing portion that are securely coupled to one another, with the biased lock member being at least partially disposed between the front and rear housing portions.

14. The toilet handle lock device of claim 13, wherein the rear housing portion includes a flexible spring tab formed in a rear wall thereof, the flexible spring tab assuming a bent configuration in a rest position thereof, the biased lock member including an inner wall, wherein in the extended locked position, the flexible spring tab seats against the inner wall to create an interference fit that prevents the biased lock member from moving from the extended locked position to the retracted unlocked position.

15. The toilet handle lock device of claim 12, further including a second protrusion that is spaced from the first protrusion, the second protrusion serving as a grip surface to allow a user to retract the biased lock member to the unlocked position.

* * * * *